US005361679A

United States Patent [19]

Foster

[11] Patent Number: 5,361,679

[45] Date of Patent: Nov. 8, 1994

[54] DIRECTIONAL CONTROL VALVE WITH PILOT OPERATED POPPET VALVES

[76] Inventor: Raymond K. Foster, P.O. Box 1, Madras, Oreg. 97741

[21] Appl. No.: 54,534

[22] Filed: Apr. 28, 1993

[51] Int. Cl.[5] ..... F15B 11/08; F15B 13/04

[52] U.S. Cl. ..... 91/448; 91/461; 137/596.15

[58] Field of Search ..... 137/596.15, 596.16, 137/625.65; 91/454, 457, 461, 448

[56] References Cited

U.S. PATENT DOCUMENTS

| | | | |
|---|---|---|---|
| 3,556,144 | 1/1971 | Bickers et al. | 137/596.15 |
| 3,831,725 | 8/1974 | Schott | 137/596.15 X |
| 4,083,381 | 4/1978 | McClocklin et al. | 137/596.15 |
| 4,149,565 | 4/1979 | Jennings et al. | 137/596.15 X |
| 4,201,116 | 5/1980 | Martin | 137/625.64 X |
| 4,611,528 | 9/1986 | Nanda et al. | 137/596.15 X |
| 5,076,537 | 12/1991 | Mears, Jr. | 137/625.65 X |
| 5,117,869 | 6/1992 | Kolchinsky | 137/625.65 |
| 5,156,184 | 10/1992 | Kolchinsky | 137/625.65 X |

*Primary Examiner*—Edward K. Look
*Assistant Examiner*—John Ryznic
*Attorney, Agent, or Firm*—Joan H. Pauly; Delbert J. Barnard; Glenn D. Bellamy

[57] ABSTRACT

Shown is a direction control valve (16) for use in a hydraulic control system having a source of hydraulic pressure (P) and a return passageway (50). The control valve includes a first hydraulic flow pathway (140, 142) and a second hydraulic flow pathway (144, 146). A two-position valve (38) includes four ports (48, 58, 64, 74). First and second pilot-operated poppets (88, 90) each have a pilot chamber (84, 86). When the valve (38) is in its first position, the source of hydraulic pressure (P) is provided to the pilot chamber (86) of the first poppet (88) and the pilot chamber (84) of the second poppet (90) is connected to the return pathway (50). As a result, one hydraulic flow pathway (140, 142) is open and the other hydraulic flow pathway (144, 146) is closed.

8 Claims, 4 Drawing Sheets

DIRECTIONAL CONTROL VALVE WITH PILOT OPERATED POPPET VALVES

TECHNICAL FIELD

This invention relates to a two-position directional control valve, and particularly to such a valve in which the poppets are pilot operated to divert hydraulic pressure and return between first and second pathways.

BACKGROUND OF THE INVENTION

In a hydraulic pressure system, direction of operation may be controlled by a switching valve or by selectively opening and closing hydraulic flow pathways.

A typical switching valve in the form of a two-position, four way valve can be moved between first and second positions to switch delivery of hydraulic pressure and return between a pair of pathways. A standard four way valve, like a rotary valve or spool valve, however, can require a great amount of force to operate and can have a "lag" time in which the valve is between positions. In high pressure installations, this lag time can be detrimental to system operation and can result in increased wear.

SUMMARY OF THE INVENTION

The present invention provides a direction control valve for use in a hydraulic control system having a source of hydraulic pressure and a return passageway. The direction control valve includes first and second hydraulic flow pathways through which oil is delivered to operate a hydraulic system. A two-position valve having four ports is provided. A first port is connected the source of hydraulic pressure and a second port is connected to the return passageway. The control valve also includes first and second pilot-operated poppets each having a poppet chamber and each operatively positioned to open and close one of the hydraulic flow pathways. The third port of the valve is operatively connected to the pilot chamber of the first poppet and the fourth port is operatively connected to the pilot chamber of the second poppet. In the first position, hydraulic pressure is directed to the pilot chamber of the first poppet and the pilot chamber of the second poppet is connected to return. In this position, one hydraulic flow pathway is open and the other is closed. In the second position, the pilot chamber of the first poppet is connected to return and the pilot chamber of the second poppet is connected to the source of hydraulic pressure. In this position, the hydraulic flow pathway that was previously closed is opened and the flow pathway that was previously open is closed.

This invention provides a direction control valve in which "lag" time in switching is minimized or eliminated due to the virtually instantaneous operation of the poppets.

Other features, objects and advantages of the present invention will become apparent upon consideration of the following best mode for carrying out the preferred embodiment of the invention, the claims, and drawings, all of which comprise a part of the present disclosure.

BRIEF DESCRIPTION OF THE DRAWINGS

Like reference numerals are used to designate like parts throughout the several views of the drawing, and.

BEST MODE FOR CARRYING OUT THE INVENTION

Figure 1:
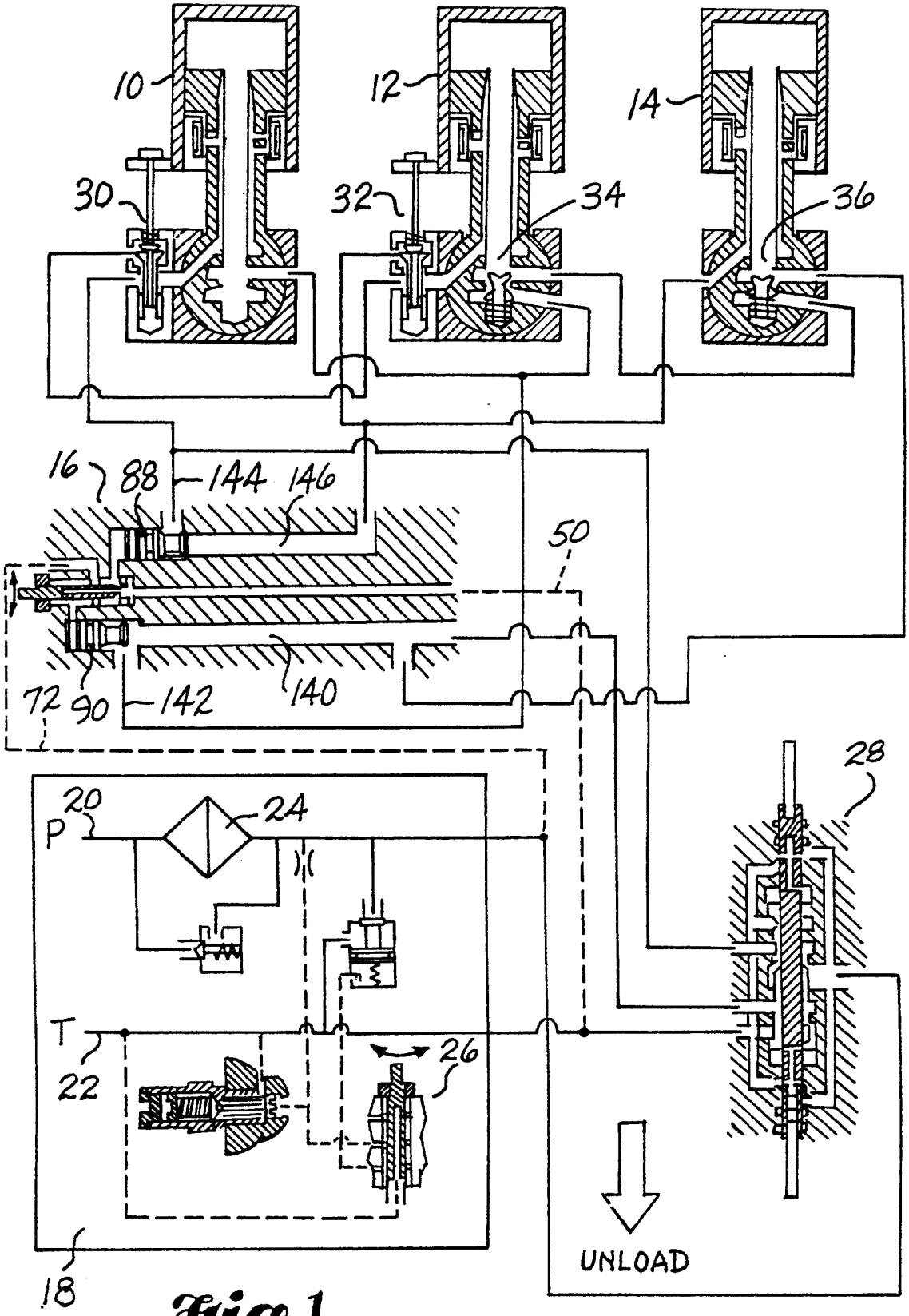
FIG. 1 is a schematic diagram of three linear hydraulic motors and a control system for automatically controlling hydraulic fluid pressure to and from the working chambers of the motors.

FIG. 1 shows a system of linear hydraulic motors that is similar to the system shown in my U.S. Pat. No. 5,193,661, granted Mar. 16, 1993. Like the system disclosed in U.S. Pat. No. 5,193,661, the system of FIG. 1 is designed for controlling the floor slats of a reciprocating floor conveyor. In operation, all three piston-cylinder units (also herein referred to as "drive units") 10, 12, 14 are retracted in unison to convey a load. Then, they are extended, one at a time, for returning the floor slats to a start position, one-third of the slats at a time. This sequence is described in my U.S. Pat. No. 5,193,661, and also in my U.S. Pat. No. 5,125,502, granted Jun. 30, 1992, and in my U.S. Pat. No. 4,748,893, granted Jun. 7, 1988.

Referring to FIG. 1, element 16 is a directional control valve. This valve 16 has two positions. In one position, valve 16 directs the drive units 10, 12, 14 to unload a load. For example, if the conveyor is in a trailer, the drive units 10, 12, 14 would move the floor slat members in unison towards the rear of the trailer, to unload the cargo in the trailer. When valve 16 is in its second position, it directs drive units 10, 12, 14 to load the trailer. The drive units 10, 12, 14 are moved in unison towards the front end of the trailer, to move the load towards the front end of the trailer. Valve 16 forms the subject matter of this application. It will be hereinafter described in detail.

Assembly 18 includes a port 20 connected to a pump or other source of hydraulic oil pressure and a port 22 connected to return or tank. It preferably includes a filter 24, an on-off valve 26 and other valving which protects the system from inadvertent misconnection of port 22 to the pump and port 20 to the tank. Assembly 18 forms the subject matter of my co-pending application Ser. No. 08/054,532, filed on Apr. 28, 1993, and entitled "Protective Connection To Pressure And Return."

Valve 28 is a switching valve. This valve is disclosed in my U.S. Pat. No. 5,103,866, granted Apr. 14, 1992, and entitled "Poppet Valve And Valve Assemblies Utilizing Same." Valve 28 is also disclosed and described in my U.S. Pat. No. 5,125,502, granted Jun. 30, 1992, and entitled "Drive Mechanism For A Reciprocating Floor Conveyor."

Valves 30, 32 are "pull" type sequencing valves. They function like valves LV4, LV5, LV6 disclosed in my U.S. Pat. No. 5,193,661, granted Mar. 16, 1993. Valves 30, 32 are a valve type that is disclosed in my co-pending application Ser. No. 07/967,752, filed Oct. 28, 1992, and entitled "Check Valve Pull Assembly" now U.S. Pat. No. 5,255,712.

Drive units 12, 14 also include "push" type sequencing valves 34, 36. Valves 34, 36 are a valve type that form the subject matter of my co-pending application Ser. No. 08/054,530, filed Apr. 28, 1993, and entitled "Internal Check Valve."

In preferred form, the drive units include an end of stroke cushion that is disclosed in my co-pending application Ser. No. 08/054,531, filed on Apr. 28, 1993, and entitled "End of Stroke Cushion For A Linear Hydraulic Motor."

The above-identified patents and applications are hereby incorporated herein by this specific reference.

Figure 2:
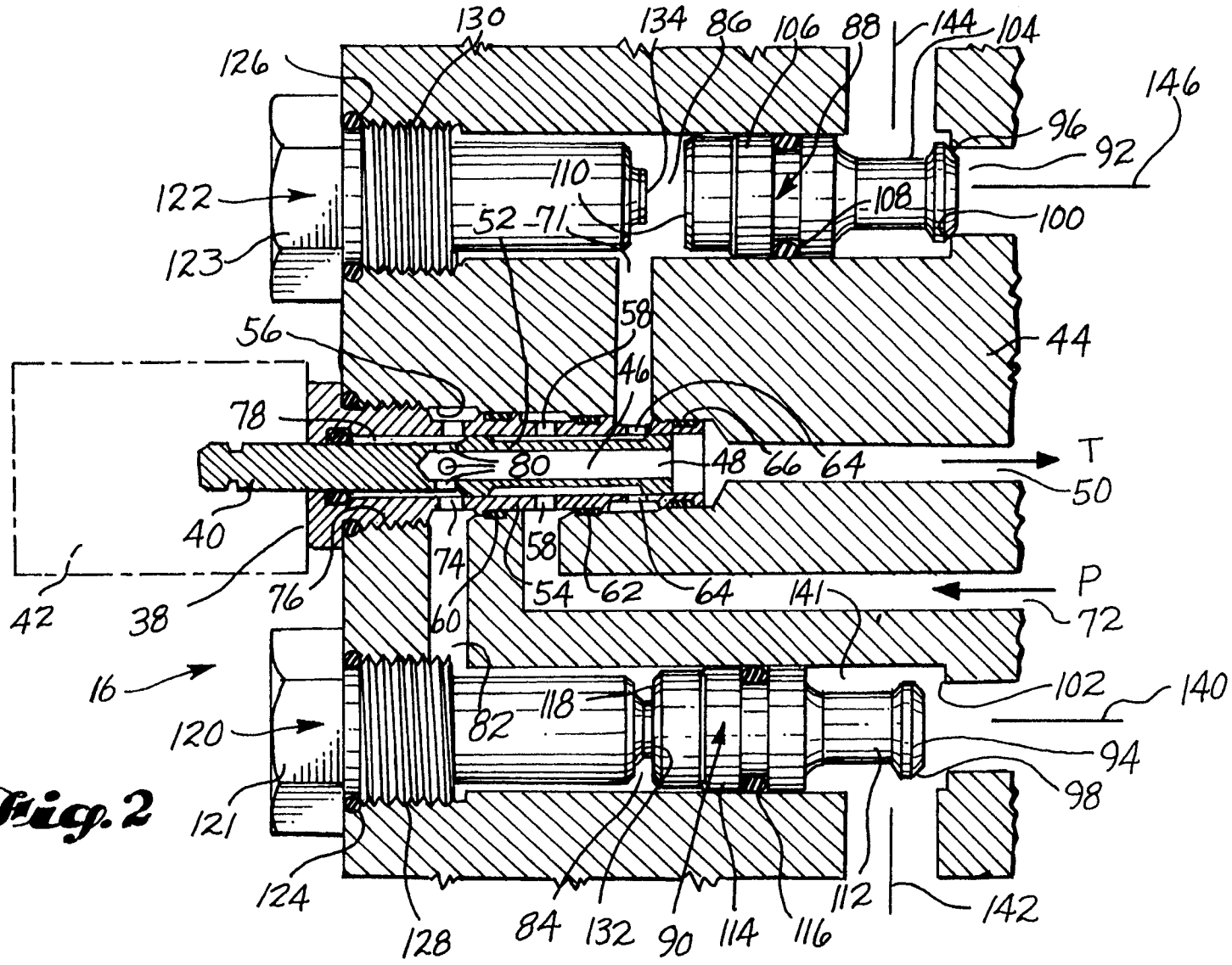
FIG. 2 is an enlarged scale longitudinal sectional view of a valve block, including a longitudinal sectional view of a four-way, two-position cartridge valve, shown in a first position, and including elevational views of two poppet valve members and two stroke limiters.
Figure 3:
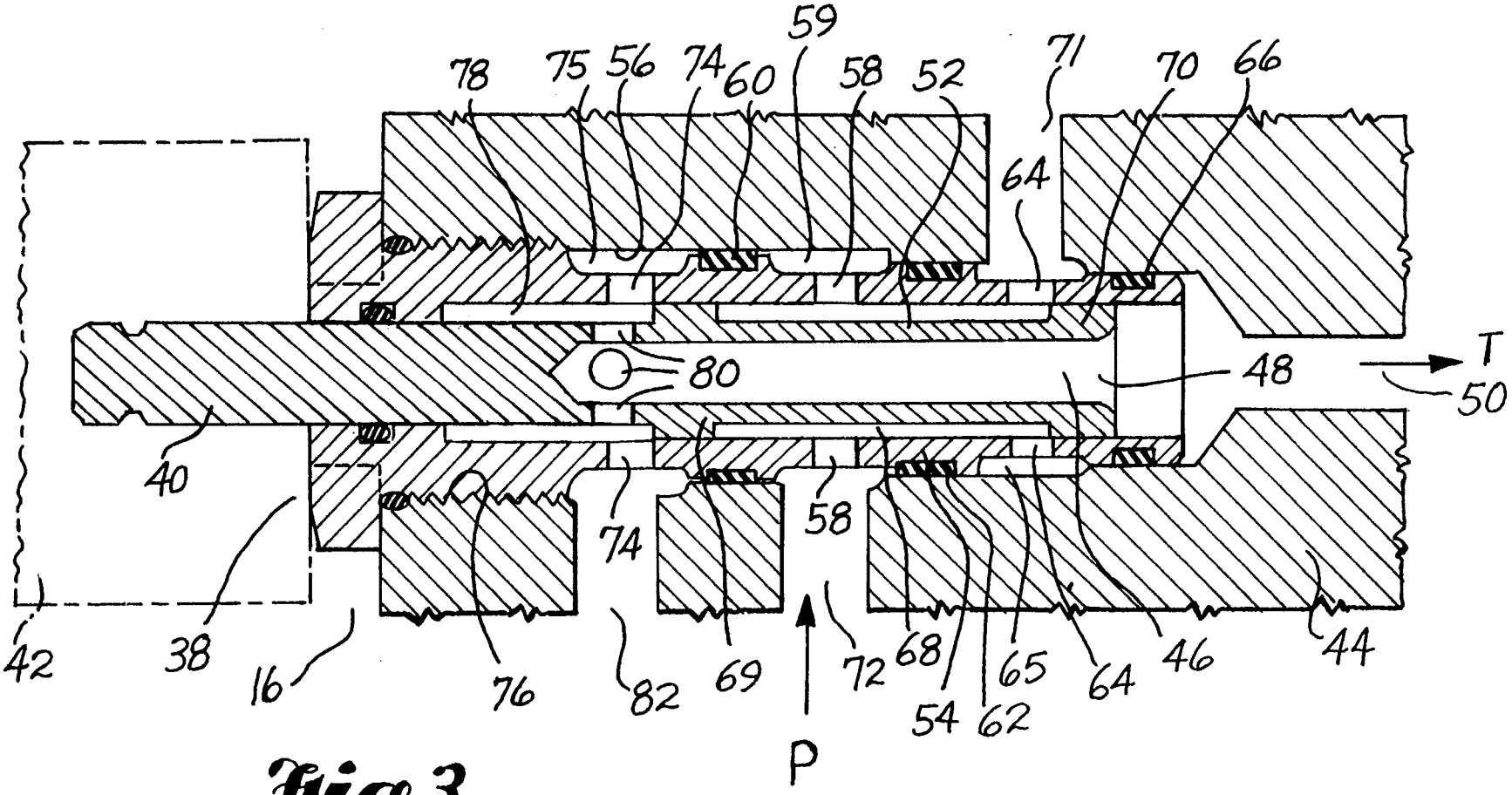
FIG. 3 is an enlarged scale view of the four-way, two-position cartridge valve shown in FIG. 2.
Figure 4:
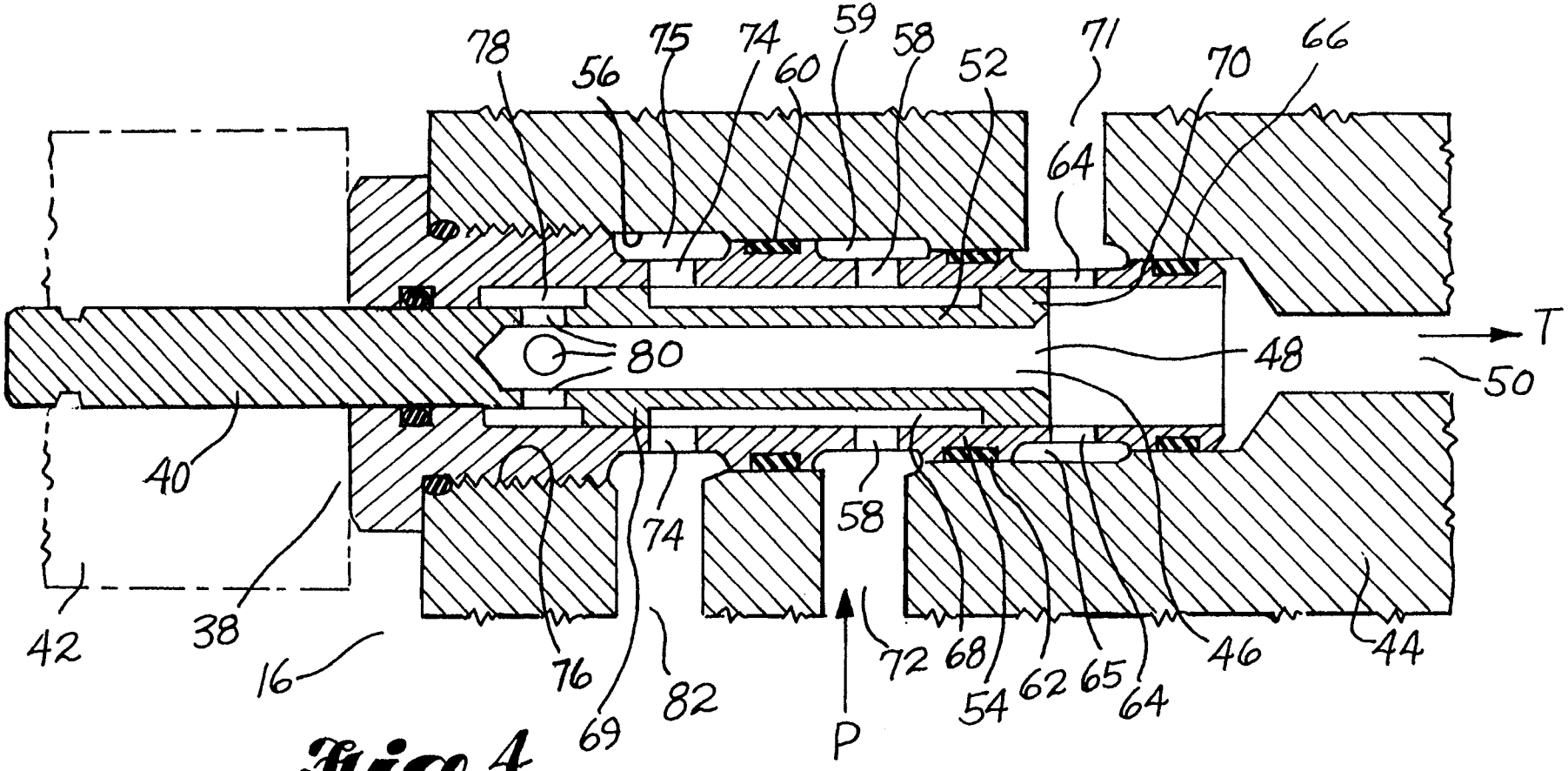
FIG. 4 is a view like FIG. 2, but showing the four-way, two-position valve in its second position and showing the poppet valve members in their second positions.

Referring to FIGS. 2–4, valve assembly 16 includes a four-way, two-position, cartridge valve 38. The valve 38 includes a screw actuator 40 that may be rotated manually or by a solenoid drive 42. Valve 16 is built into a body 44 which may be a block of aluminum into which passageways and sockets have been formed. Valve 38 includes a central passageway 46. Passageway 46 includes an end port 48 which is in constant communication with a passageway 50 that leads to tank T. Valve 38 includes a rotary tubular body or valve member 52 that is fitted within a tubular sleeve 54. Sleeve 54 fits within a socket 56 that is formed in the block 44. Sleeve 54 has ports 58 which communicate with an annular groove 59 (FIG. 3) that is positioned axially between a pair of seals 60, 62. Sleeve 54 also includes ports 64 which communicate with an annular groove 65 (FIG. 3) that is axially between seals 62, 66. An annular chamber 68 is formed between sleeve 52 and sleeve 54. Chamber 68 is bounded at its ends by lands 69, 70 which are also pistons.

In FIG. 2, passageway 71 is shown in communication with pressure passageway 72 via ports 58, the annular chamber 68 and ports 64. Sleeve 54 includes sidewall ports 74 that communicate with an annular chamber 75 that is axially between threads 76 and seal 60. An annular chamber 78 is formed radially between stem 40 and sleeve 54. Sleeve 52 includes sidewall ports 80. In FIG. 2, the ports 80 are aligned with ports 74. Passageway 82 is connected with passageway 46, port 48 and passageway 50, via the ports 74, 80. This connects passageway 82 and cavity 84 with tank T. Passageway 71 is connected to cavity 86. In FIG. 2, cavity 86 is connected to pressure passageway 72.

Cavity 86 includes a poppet member 88. Cavity 84 includes a poppet member 90. Poppet members 88, 90 are identical in construction. Each includes a valve plug end 92, 94 presenting a closure surface 96, 98 to a valve seat 100, 102. Closure member 92 is connected by a small diameter portion 104 to a piston 106. Piston 106 includes a seal ring 108 which seals between the piston and the sidewall of cavity 86. The poppet member 88 also includes an end surface 110. In like fashion, poppet member 90 includes a small diameter portion 112 located axially between the closure member 94 and a piston 114. Piston 114 includes a seal ring 116 and an end surface 118. The seal member 116 seals against leakage between the piston 114 and the sidewall of cavity 84.

The outer ends of the cavities 84, 86 are closed by a stroke limiter 120, 122. These elements include seals 124, 126 and threaded portions 128, 130. They preferably have a hex head cap 121, 123 which can receive the jaws of a wrench used for installing and removing the elements 120, 122. When elements 120, 122 are in place, they provide end stops 132, 134 for the pistons 88, 90. In FIG. 2, end surface 118 of poppet member 90 is against stop 132. End surface 110 of poppet member 88 is spaced axially from stop 134. The stops are end portions of the inserts 120, 122 which are smaller in diameter than the cavities 84, 86.

When the valve 38 is in the position shown by FIG. 2, the pressure within cavity 86 acts on end surface 110 and pushes the poppet member 88 endwise to move the closure surface 96 against valve seat 100. Cavity 84 is connected to tank T. Pressure in cavity 141 acts on poppet member 90 and moves poppet member 90 endwise against its stop 132. This opens a space between closure surface 98 and valve seat 102 which communicates passageway 140 with passageway 142. Poppet member 88 closes a similar passageway that is between passageway 144 and passageway 146.

Referring to FIG. 4, it can be seen that the valve actuator 40 has been moved to its second position. In this position, pressure passageway 72 is connected to passageway 82 through annular chamber 59, port 58, annular chamber 68, port 74 and annular chamber 75. Passageway 71 has been connected to passageway 50, leading to tank T, through passageway 64.

As can be seen by making a comparison of the valve as shown in FIG. 4 with the system as shown in FIG. 2, this valve position causes chamber 84 to be connected to pressure from passageway 72. This connection is made from passageway 72 to annular chamber 59, through port 58, annular chamber 68, port 74 and passageway 82. Application of pressure to cavity 84 acts against the piston 114 to shift poppet 90 into a closed position, forcing closure surface 98 against valve seat 102. This closes passageway 140 to passageway 142. Likewise, cavity 86 is connected to tank T through passageway 71, port 64, and passageway 50. Connecting cavity 86 to tank, when pressure is present in passageway 144 or passageway 146 causes poppet 88 to shift to an open position against insert 122. In this position, passageway 144 is open to passageway 146.

Referring to FIG. 1, as previously described, valve 28 is a switching valve. This valve is operated in response to end of stroke movement of one or more linear hydraulic motors 10, 12, 14. Shifting of switching valve 28 causes the drive units 10, 12, 14 to move either in unison toward one direction, or sequentially in the opposite direction. The function of valve combination 16, the subject matter of the present application, is to interchange the directions in which drive units 10, 12, 14 move simultaneously in sequence. As can be seen in FIG. 1, passageway 72 provides a flow of hydraulic pressure from the pump P and passageway 50 provides a return of hydraulic oil to tank T. The respective opening and closing of poppets 88, 90 divert the flow of hydraulic oil in order to accomplish this reversal.

It should be understood that many variations could be made in the implementation of the present invention without departing from its spirit and scope. The described preferred embodiment does not define the scope of patent protection. Instead, patent protection is to be determined by the following claim or claims properly construed according to doctrines of claim interpretation, including the doctrine of equivalents and reversal of parts.

What is claimed is:

1. In a hydraulic control system having a source of hydraulic pressure and a return passageway, a direction control valve, comprising:

first and second hydraulic flow pathways;

first and second pilot-operated valve means, each operatively positioned to open and close one of said first and second hydraulic flow pathways;

switching means for directing hydraulic pressure selectively to either one of said first and second pilot-operated valve means for providing rapid, pressure-responsive opening and closing of said pilot-operated valve means;

said switching means having connections to the source of hydraulic pressure and the return passageway, and valve means operatively connected to said hydraulic flow pathways such that said hydraulic flow pathways are selectively connectable to the source of hydraulic pressure and the return passageway independently of said connections of said switching means.

2. In a hydraulic control system having a source of hydraulic pressure and a return passageway, a direction control valve, comprising:

first and second hydraulic flow pathways;

two-position valve means having connections to the source of hydraulic pressure and the return passageway for directing flow from the source of hydraulic pressure and to the return passageway;

first poppet valve means for rapid opening and closing of said first hydraulic flow pathway;

second poppet valve means for rapid opening and closing of said second hydraulic flow pathway; and a switching valve operatively connected to said hydraulic flow pathways, said two-position valve means directing hydraulic pressure for selective opening and closing of said first and second poppet valve means, and said hydraulic flow pathways being selectively connectable to the source of hydraulic pressure and the return passageway independently of said connections of said two-position valve means.

3. In a hydraulic control system having a source of hydraulic pressure and a return passageway, a direction control valve, comprising:

first and second hydraulic flow pathways;

a two-position valve having four ports, including a first port in constant operative communication with the source of hydraulic pressure and a second port in constant operative communication with the return passageway;

first and second pilot-operated poppets each having a pilot chamber and each operatively positioned to open close one of said first and second hydraulic flow pathways; and a third one of said ports being operatively connected to the pilot chamber of the first poppet and a fourth one of said ports being operatively connected to the pilot chamber of the second poppet, and a switching valve operatively connected to said hydraulic flow pathways, wherein said hydraulic flow pathways are selectively connectable to the source of hydraulic pressure and the return passageway independently of said communication of said first and second ports with the source of hydraulic pressure and the return passageway, wherein said two-position valve includes a valve member having a first position in which said first and second ports communicate with said third and fourth ports, respectively, to provide hydraulic pressure to the pilot chamber of the first poppet and connect the pilot chamber of the second poppet to the return passageway such that one of said hydraulic flow pathways is closed and the other hydraulic flow pathway is open, and wherein said valve member has a second position in which said first and second ports communicate with said fourth and third ports, respectively, to provide hydraulic pressure to the pilot chamber of said second poppet and connect the pilot chamber of the first poppet to the return passageway, such that said one hydraulic flow pathway is opened and said other hydraulic flow pathway is closed.

4. The direction control valve of claim 1, further comprising a solid body through which said first and second hydraulic flow pathways are formed and into which cavities are formed to operatively receive said two-position valve and said first and second pilot-operated poppets, wherein said two-position valve is a cartridge valve received by threads into one of said cavities in said body.

5. The direction control valve of claim 4, wherein said first and second poppets include a cavity-sealing insert removably positioned in an end portion of each said cavity that receives one of said poppets for defining each said pilot chamber.

6. The direction control valve of claim 4, wherein said first and second poppets are separate members for operation independent of one another.

7. The direction control valve of claim 3, wherein said first and second poppets are separate members for operation independent of one another.

8. The direction control valve of claim 3, wherein said valve member is received into an axial opening, one of said first and second ports is an end port opening onto an end portion of said axial opening, and said end port communicates with one of said third and fourth ports directly through said axial opening and with the other of said third and fourth ports via an axial passageway and a radial passageway in said valve member.

* * * * *

UNITED STATES PATENT AND TRADEMARK OFFICE

CERTIFICATE OF CORRECTION

PATENT NO: 5,361,679

DATED: November 8, 1994

INVENTOR(S): Raymond Keith Foster

It is certified that error appears in the above-identified patent and that said Letters Patent are hereby corrected as shown below:

In claim 3, column 5, line 52, insert -- and -- between "open" and "close"; and in line 53, delete "and".

Signed and Sealed this

Ninth Day of July, 1996

*Attest:*

Bruce Lehman

BRUCE LEHMAN

*Attesting Officer*

*Commissioner of Patents and Trademarks*